US005472819A

United States Patent [19]

Hayashi et al.

[11] Patent Number: 5,472,819

[45] Date of Patent: Dec. 5, 1995

[54] TONER AND DEVELOPER COMPOSITION CONTAINING THE SAME

[75] Inventors: Nirohiro Hayashi; Kanji Yoshimura; Tohru Katoh; Kuniyasu Kawabe, all of Wakayama, Japan

[73] Assignee: Kao Corporation, Tokyo, Japan

[21] Appl. No.: 271,745

[22] Filed: Jul. 7, 1994

[30] Foreign Application Priority Data

Jul. 8, 1993 [JP] Japan ..... 5-169189

[51] Int. Cl.[6] ..... G03G 9/097

[52] U.S. Cl. ..... 430/110; 430/137

[58] Field of Search ..... 430/137, 109

[56] References Cited

U.S. PATENT DOCUMENTS

| | | | |
|---|---|---|---|
| 3,590,000 | 6/1971 | Palermiti et al. | 252/62.1 |
| 3,635,704 | 2/1972 | Palermiti et al. | 96/1 |
| 3,655,374 | 4/1972 | Palermiti et al. | 96/1.4 |
| 5,364,728 | 11/1994 | Ohta et al. | 430/109 |

FOREIGN PATENT DOCUMENTS

| | | |
|---|---|---|
| 1013558 | 2/1982 | Japan . |
| 57-086837 | 5/1982 | Japan . |
| 60-146252 | 8/1985 | Japan . |
| 63-073269 | 2/1988 | Japan . |
| 63-73269 | 8/1988 | Japan . |
| 4142301 | 3/1990 | Japan . |
| 04084142 | 2/1992 | Japan . |
| 1570239 | 7/1977 | United Kingdom . |

OTHER PUBLICATIONS

US 3590000 & US 3655374 Corresponding to JPA 71-12680 which was disclosed in Specification.

*Primary Examiner*—John Goodrow

*Attorney, Agent, or Firm*—Birch, Stewart, Kolasch & Birch

[57] ABSTRACT

A developer composition of the present invention contains a toner having at least a binder resin, a coloring agent and a toner scum preventive. The binder resin contains as a main component a polyester resin or a resin produced by concurrently carrying out addition polymerization and condensation polymerization in one reaction vessel. By using the toner of the present invention, since the formation of toner scum on the carrier surface can be prevented for a long period of time in the service life of the developer while retaining the low-temperature fixing ability of the toner, the carrier resistance and the triboelectric charge can be stably maintained, thereby providing a developer composition with a long service life. Accordingly, besides having a long service life mentioned above, the developer composition is highly suitably used for a high-speed semiconductive magnetic development.

11 Claims, 1 Drawing Sheet

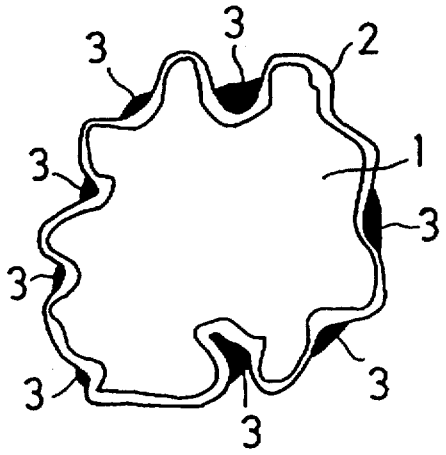
FIG. 1(a)
FIG. 1(b)
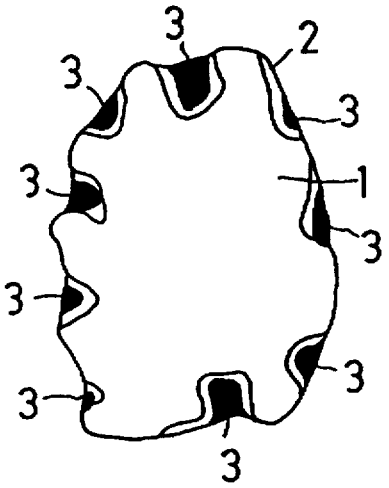
FIG. 1(c)
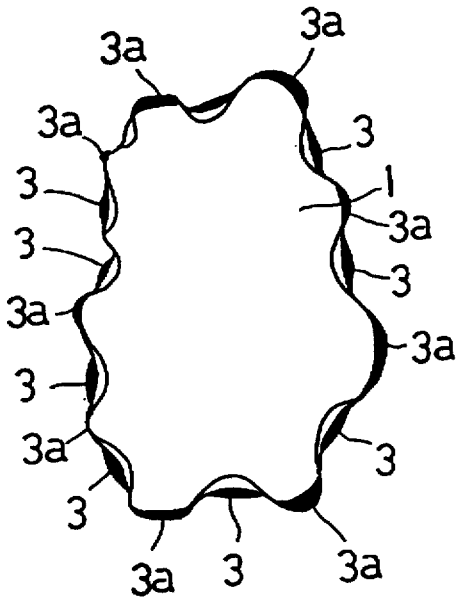

TONER AND DEVELOPER COMPOSITION CONTAINING THE SAME

BACKGROUND OF THE INVENTION

1. Field of the Invention

The present invention relates to a toner and a developer composition used for a dry-type, two-component development method wherein electrostatic latent images are developed using image-forming apparatuses such as laser printers and dry-type electrostatic copying machines. More particularly, it relates to a toner and a developer composition capable of maintaining carrier resistance and triboelectric charge with substantially no change for a long period of time by reducing the toner scum of the carrier, thereby maintaining high image quality.

2. Discussion of the Related Art

As described in U.S. Pat. Nos. 2,221,776, 2,297,691 and 2,357,809 and other publications, the conventional electrophotography using an image-forming apparatus such as a dry-type electrostatic copying machine comprises the steps of evenly charging a photoconductive insulating layer (a charging process); subsequently exposing the layer to eliminate the charge on the exposed portion so as to form an electrostatic latent image (an exposing process); visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process).

As stated above, a toner must meet the requirements not only in the development process but also in the transfer process and fixing process.

As suitable development methods for electrophotography, there are basically two kinds, i.e., a dry-type development method and a wet-type development method. In the dry-type development method, there are a method utilizing a one-component system developer and a method utilizing a two-component system developer comprising a toner and a carrier.

As methods utilizing two-component system developers, a magnetic brush development utilizing a magnetic powder carrier (see U.S. Pat. No. 2,786,439) and a cascade development utilizing a bead carrier with a relatively large particle size (see U.S. Pat. No. 2,618,551) have been known, the above method having two different conveying systems of toners.

As toners used for such development methods, it has generally known to use fine particles obtained by the steps of mixing and dispersing various functional additives including coloring agents, such as dyes and pigments, charge control agents and waxes in binder resins such as styrene-acrylate copolymer (polystyrene type) resins, polyester resins and epoxy resins, and then pulverizing the obtained dispersion mixture to a particle size of 1 to 80 μm.

For the two-component system developers mentioned above, long service life, specifically, stability and retainability of image quality in continuous development, is generally in demand. In order to achieve the long service life required for the developer, triboelectric charge and developer resistance for the toner and the carrier used have to be maintained within suitable ranges. It is particularly desired that the initial values of the triboelectric charge and developer resistance do not change even at the end of the long-time durability test.

For the purpose of stably maintaining the triboelectric charge and developer resistance of these developers, various investigations have been made from the toner side as to the designs and choices of binder resins, charge control agents and other additive, and also from the carrier side as to the oxidation treatment methods for iron particles, essential materials constituting carriers such as ferrites and magnetites, surface shapes of these magnetic particles, coating materials and treatment methods therefor.

Particularly in the case where a high-speed development is carried out, since a large amount of developer has to be used, a large mechanical force for stirring the developer is required, so that the developer is drastically deteriorated by the repetition of collision of the developer and the stirring member of the developer device.

In order to reduce such a deterioration of the developer, the bulk density of the carrier can be made small by using porous, irregular-shaped iron particles which is a so-called "sponge" as a carrier, so that the stirring torque can be made lower. As the developing speed increases, carriers existing in the vicinity of the photoconductor are likely to be "charged up" at development, thereby making it likely to increase the edge effects of the solid image portion. This problem can be solved by such subsidiary effects as increase in the electric field strength in development. The reasons for the increase in the electric field strength are as follows: The presence of the porous, irregular-shaped iron particles provides an increase in contact points between the particles, so that the bias current is increased, which in turn increases the electric field strength. Therefore, the carriers having such a structure are highly suitable for high-speed printers and copying machines utilizing semiconductive methods.

Further, when a carrier is made porous, the low-surface energy coating material formed on the projecting portion of the carrier particles is detached during repetitive use thereof, which in turn leads to generate toner fine particles in the developer device and to constitute the nucleus, so that a thin layer which is a so-called "toner scum" is formed onto the bare surface, thereby increasing the surface frictional resistance of the carrier. Therefore, it would be difficult to make development bias voltage reach the tip end of brush near the photoconductor surface, thereby decreasing the image density of the formed image, particularly making it difficult to reproduce the solid image portion. Also, particularly in the case of using high-speed copying machines and printers, low-temperature fixing ability of the toner is required, but in the case where the temperature in the developer device reaches not less than 50° C. by its continuous use, the so called "toner scum phenomenon" is likely to take place, wherein the low-temperature fixing toner is thermally fused and solidified on the projecting portion of the carrier. Therefore, a low-temperature fixing ability and a long service life required for the developer cannot be simultaneously met satisfactorily.

FIGS. 1(*a*)–(*c*) are schematic views each showing the mechanism of the toner scum formation. In the figure, the carrier comprises a core 1 made of porous iron particles having a rugged surface, and a conductive coating material 2 formed on the surface of the core 1.

Specifically, FIG. 1(*a*) schematically shows a carrier in its initial state where dents of the core 1 are filled with the toner 3, but no toners are present on the projecting portions, so that these projecting portions effectively serve as contact points for adjacent carriers. However, as shown in FIG. 1(*b*), the coating material 2 present in the projecting portions is detached by frictional forces caused during the repetitive use of the carrier, so that toner scum is likely to take place, thereby forming toner scum 3a with toners 3 on these bare projecting portions as shown in FIG. 1(*c*).

It is well known that each of the carriers are linearly connected between the developing sleeve and the photoconductor by making the projecting portions mentioned above as the contact points, the carriers serving to supply charged toner 3 to an electrostatic latent image formed on the surface of the photoconductor. However, when the surface frictional resistance of the carrier is undesirably increased by the formation of the toner scum 3a, bias voltage applied is not easily conducted to the photoconductor through the developing sleeve, thereby resulting in the decrease in the amount of toners 3 supplied onto the surface of photoconductor, which in turn causes a decrease in the image density as described above.

As materials not only serving to improve cleaning ability of the toners using the carrier having this type of structure but also serving to prevent offset phenomenon and reduce friction of the photoconductor, it has been conventionally known to externally add a suitable amount of a lubricant such as zinc stearate to toner particles. For instance, as disclosed in Japanese Patent Laid-Open No. 46-12680, zinc stearate is externally added to a toner using a linear polyester as a binder resin in order to lubricate the outer surface of toner particles. In this method, even though the coating material on the projecting portion may wear out, since the toner particles are not easily adhered to the carrier surface, the decrease in image density after a long period of use can be prevented, thereby showing a long service life.

However, in the toner thus obtained by externally adding a lubricant, the lubricant is likely to be separated from the toner. Particularly in the transfer process, the lubricant which becomes detached from the toner is in turn adhered onto the surface of the photoconductor, thereby forming an insulating layer on the surface of the photoconductor during the continuous development. Moreover, the detachment of the lubricant gives drastic influence on the chargeability of the toner itself, which in turn generates image deterioration such as background due to the decrease in the triboelectric charge and the decrease of the developer resistance caused by improvement in fluidity of the developer.

Accordingly, in the two-component system developer using a carrier made of a porous, irregular-shaped iron powder having a rugged surface, a developer composition capable of stably maintaining carrier resistance and triboelectric charge for a long period of time while retaining good low-temperature fixing ability of the toner is in demand.

SUMMARY OF THE INVENTION

Accordingly, an object of the present invention is to provide a toner capable of stably maintaining carrier resistance and triboelectric charge for a long period of time while retaining good low-temperature fixing ability of the toner in the two-component system developer using a carrier made of a porous, irregular-shaped iron powder having a rugged surface.

Another object of the present invention is to provide a developer composition containing such a toner.

As a result of intense research in view of the above problems, the present inventors have found that a developer composition having an extremely small amount of toner scum on the carrier surface, the developer composition being capable of stably maintaining carrier resistance and triboelectric charge for a long period of time while retaining good low-temperature fixing ability of the toner, can be obtained by using, as a main component of a binder resin, a polyester resin or a resin obtained by concurrently carrying out addition polymerization and condensation polymerization in one reaction vessel, and adding internally a toner scum preventive to the toner, and thus completed the present invention.

Specifically, the present invention is concerned with the following:

(1) A toner comprising at least a binder resin and a coloring agent, wherein the binder resin comprises as a main component a polyester resin or a resin produced by concurrently carrying out addition polymerization and condensation polymerization in one reaction vessel, the toner containing a toner scum preventive; and (2) A developer composition comprising a carrier having a rugged surface and the toner described in (1) above.

More specifically, the toner scum preventive is at least one selected from the group consisting of:

(a) an aliphatic acid, metal salts thereof, and mixtures thereof;

(b) a monoalkyl phosphate, a dialkyl phosphate, and mixtures thereof;

(c) carbonyloxy and amido groups-containing amine, salts thereof, and mixtures thereof; and (d) a compound having the following general formula (D-1):

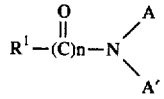

(D-1)

wherein $R^1$ represents an alkyl group, aralkyl group or alkenyl group, each having 7 to 24 carbon atoms; A and A', which may be identical or different, independently represent a hydrogen atom, methyl group or $-CH_2CH_2OR^2$, wherein $R^2$ represents a hydrogen atom, an alkyl group, aralkyl group or alkenyl group each having 8 to 24 carbon atoms, or

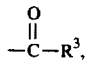

wherein $R^3$ represents an alkyl group, aralkyl group or alkenyl group, each having 8 to 24 carbon atoms; and n is equal to 0 or 1.

By using the toner of the present invention, since the formation of toner scum on the carrier surface can be prevented for a long period of time in the service life of the developer while retaining the low-temperature fixing ability of the toner, the carrier resistance and the triboelectric charge can be stably maintained, thereby providing a developer composition with a long service life. Accordingly, besides having a long service life mentioned above, the developer composition is highly suitably used for a high-speed semiconductive magnetic development.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 1(*a*)–(*c*) are schematic views showing the mechanism of toner scum formation, wherein each of figures show the change in toner scum formation with the passage of time.

The reference numerals in FIGS. 1(*a*) through (*c*) denote the following elements:

Element 1 is a core of a carrier, element 2 a conductive coating material coating the surface thereof, element 3 a toner, and element 3*a* is a portion of the carrier on which toner scum is formed.

DETAILED DESCRIPTION OF THE INVENTION

The present invention is concerned with a toner obtained by internally adding a toner scum preventive to the toner, and the developer composition containing the above toner. Here, "internally adding to the toner" refers to adding a toner scum preventive to a binder resin and kneading the mixture so as to obtain a toner containing the toner scum preventive in the inner portion thereof. Further, "toner scum preventive" refers to an additive having a function of preventing adhesion of the toner onto projecting portions of a carrier by reducing frictional resistance to the carrier surface, thereby preventing a formation of toner scum.

There are basically two preferred embodiments for the toner and the developer composition of the present invention, depending on the types of the binder resins constituting the toner as shown below:

In Preferred Embodiment I, the binder resin comprises a polyester resin as a main component.

In Preferred Embodiment II, the binder resin comprises as a main component a resin obtained by concurrently carrying out addition polymerization and condensation polymerization in one reaction vessel.

Each of the embodiments will be described in detail below.

Preferred Embodiment I

As for the polyester resin used in Embodiment I, in order to meet the requirements of the thermal properties for fixing the toner, which are important features for the toner, it is preferred that the polyester resin has a crosslinked structure formed with at least one trivalent or higher valent polyfunctional monomer, that the softening point as determined by koka-shiki type flow tester is not less than 95° C. and not more than 160° C., and that the temperature difference between the outflow initiating temperature and the softening point is 15° to 50° C. When the softening point is less than 95° C., the resulting developer has poor offset resistance and blocking resistance, and when it exceeds 160° C., the resulting developer has poor low-temperature fixing ability. Similarly, when the temperature difference between the outflow initiating temperature and the softening point is less than 15° C., the resulting developer has poor offset resistance and blocking resistance, and when it exceeds 50° C., the resulting developer has poor low-temperature fixing ability.

Incidentally, the koka-shiki type flow tester is a device conveniently used for the evaluation of the binder resin for toners, wherein melting behavior of resins, etc. can be tested with good reproducibility at each temperature.

Specifically, the "softening point as determined by the koka-shiki type flow tester" used herein refers to the temperature corresponding to one-half of the height (h) of the S-shaped curve showing the relationship between the downward movement of a plunger (flow length) and temperature, when measured by using a flow tester of the koka-shiki type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 20 $kg/cm^2$ thereto with the plunger.

Also, the polyester resin has a glass transition temperature as determined by differential scanning calorimeter (DSC) of preferably not less than 50° C. and not more than 80° C. When the glass transition temperature is less than 50° C., the resulting toner is likely to be agglomerated, thereby making its stability poor. When it exceeds 80° C., fixing failure of the toner is undesirably likely to take place, and the pulverizability of the toner upon production is also poor.

The polyesters used in the present invention can be formed between starting material monomers of a dihydric or higher polyhydric alcohol component and a dicarboxylic or higher polycarboxylic acid component such as a carboxylic acid, a carboxylic acid anhydride or a carboxylic acid ester.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene oxide adducts of bisphenol A, ethylene oxide adducts of bisphenol A, hydrogenated bisphenol A and other dihydric alcohol components.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol components.

Among these alcohol monomer components, a preference is given to propylene oxide adducts of bisphenol A and ethylene oxide adducts of bisphenol A.

As for the acid components, examples of dicarboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, and acid anhydrides thereof, lower alkyl esters thereof and other dicarboxylic acid components. Among them, a preference is given to terephthalic acid.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, lower alkyl esters thereof and other tricarboxylic or higher polycarboxylic acid components. Among them, in particular, 1,2,4-benzenetricarboxylic acid, namely trimellitic acid, or a derivative thereof is preferably used because it is inexpensive and the reaction control is easy.

In the present invention, these dihydric alcohol monomers and trihydric or higher polyhydric alcohol monomers may be used singly or in combination. Also, these dicarboxylic acid monomers and tricarboxylic or higher polycarboxylic acid monomers may be used singly or in combination. In the present invention, a preference is given to a polyester obtained by a condensation of monomers containing at least trihydric or higher polyhydric alcohol component and/or tricarboxylic or higher polycarboxylic acid component.

The polyester resin described above can be synthesized by a conventional method. Specifically, the reaction is carried out at a reaction temperature of 170° to 250° C. under a pressure of 5 mmHg to normal pressure, the optimum temperature and pressure being selected depending upon the reactivity of the monomers, and the reaction is terminated at a point where it reaches to provide given properties mentioned above for the resulting resin.

Further, polyamide resins, polyester-polyamide resins, etc., which have good compatibility with the foregoing polyester resin, may be also used as a binder resin by adding them in suitable amounts to the polyester resin.

In Preferred Embodiment I of the present invention, in which the above polyester resin is used as a main component of the binder resin, a toner further contains at least one of the following toner scum preventives selected from the group consisting of:

(a) An aliphatic acid, metal salts thereof, and mixtures thereof;

(b) A monoalkyl phosphate, dialkyl phosphate, and mixtures thereof;

(c) Carbonyloxy and amido groups-containing amine (hereinafter simply referring to as "esteramide amine"), salts thereof, and mixtures thereof; and (d) A compound having the following general formula (D-1):

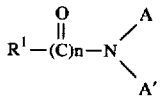

(D-1)

wherein $R^1$ represents an alkyl group, aralkyl group or alkenyl group, each having 7 to 24 carbon atoms; A and A', which may be identical or different, independently represent a hydrogen atom, methyl group or $—CH_2CH_2OR^2$, wherein $R^2$ represents a hydrogen atom, an alkyl group, aralkyl group or alkenyl group, each having 8 to 24 carbon atoms or

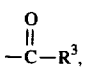

wherein $R^3$ represents an alkyl group, aralkyl group or alkenyl group, each having 8 to 24 carbon atoms; and n is equal to 0 or 1. Therefore, Embodiment I of the present invention can be subdivided into the following Embodiments I(a) to I(d).

The aliphatic acids and the metal salts thereof used in Embodiment I(a) of the present invention are internally added for the purpose of serving as a toner scum preventive for preventing the formation of toner scum on the surface in addition to the purposes of serving as a releasing agent for preventing offset phenomenon and reducing wear of the photoconductor.

Among them, examples of the aliphatic acids include coconut oil-type aliphatic acids, beef tallow-type aliphatic acids and various monomeric aliphatic acids. Specific examples of the monomeric aliphatic acids include, in an increasing order of their molecular weights, caprylic acid, captic acid, undecylic acid, lauric acid, tridecylic acid, myristic acid, palmitic acid, stearic acid, behenic acid, lignoceric acid, cerotic acid, montanic acid, oleic acid, elaidic acid, linoleic acid, linolenic acid, erucic acid, ricinoleic acid, dihydroxystearic acid, cyclic aliphatic acids, and dibasic acid, with a preference given to aliphatic acids having a long-chain alkyl group with carbon atoms not shorter than stearic acid, wherein the aliphatic acids containing 90% by weight or more of saturated aliphatic acids having not less than 18 carbon atoms.

Also, examples of metals used for the aliphatic acid metal salts include various kinds of metals such as zinc, lead, iron, copper, tin, cadmium, aluminum, calcium, magnesium, nickel, cobalt, manganese, lithium and barium. Among them, zinc laurate, zinc stearate, aluminum stearate, calcium stearate, magnesium stearate and lithium stearate are suitably used.

The aliphatic acids and the metal salts thereof can be used singly or in combination of two or more kinds. The aliphatic acids and the metal salts thereof can be added to the binder resin by a kneading method, which is an internal addition method. By using this method in the present invention, when compared with the conventional external addition method, the above aliphatic acids and the metal salts thereof can be more uniformly dispersed. Further, the —COOX group (wherein X is a hydrogen atom or a metal) of the aliphatic acids and the metal salts thereof, is adsorbed to the polar group in the binder resin, so that the long-chain alkyl group of the aliphatic acid appears on the surface of the toner. Although it is somewhat unclear, this adsorption is caused by the hydrogen bond, whereby the aliphatic acids and the metal salts thereof are quite firmly fixed to the toner. Therefore, the detachment of the aliphatic acids and the metal salts thereof from the toner in a transfer process can be presumably prevented.

Although the amount of the aliphatic acid and/or the metal salt thereof is required to be 0.1 to 5.0 parts by weight, based on 100 parts by weight of the binder resin, it is preferably 0.1 to 2.0 parts by weight in the case of the aliphatic acid, and it is preferably 0.5 to 5.0 parts by weight, particularly 0.7 to 2.0 parts by weight in the case of the aliphatic acid metal salt.

When the amount is less than 0.1 parts by weight, sufficient effects as a toner scum preventive cannot be achieved, and when it exceeds 5.0 parts by weight, the foregoing problems inherent in the conventional external addition method, namely the detachment of the aliphatic acids and the metal salts thereof from the toner, are undesirably raised.

The alkyl phosphates used in Embodiment I(b) of the present invention are internally added as a toner scum preventive for preventing the formation of toner scum on the carrier surface by reducing the surface frictional resistance of the toner.

Among them, the monoalkyl phosphate has the following general formula (B-1):

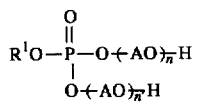

(B-1)

wherein $R^1$ is an alkyl group having 6 to 24 carbon atoms; A represents an alkylene group having 2 to 4 carbon atoms; and n and n', which may be identical or different, independently represent a number of between 0 and 30.

Also, the dialkyl phosphate has the following general formula (B-2):

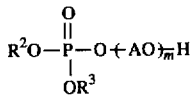

(B-2)

wherein $R^2$ and $R^3$, which may be identical or different, independently represent an alkyl group having 6 to 24 carbon atoms; A represents an alkylene group having 2 to 4 carbon atoms; and m represents a number of between 0 and 30.

Among them, a particular preference is given to the monoalkyl phosphates having $R^1$ with not less than 16 carbon atoms and dialkyl phosphates having $R^2$ and $R^3$ each with not less than 16 carbon atoms.

The monoalkyl phosphates and the dialkyl phosphates can be used singly or in combination of two or more kinds. The monoalkyl phosphates and/or the dialkyl phosphates can be added to the binder resin by a kneading method, which is an internal addition method. By using this method in the present invention, since these alkyl phosphates have good compatibility with the polyester resin, the long-chain alkyl group of these alkyl phosphates appears on the surface of the toner, so that the surface frictional resistance of the obtained toner can be reduced. Accordingly, the formation of toner scum can be prevented.

The amount of the monoalkyl phosphate and/or the dialkyl phosphate is preferably 0.1 to 5.0 parts by weight, particularly 0.5 to 2.0 parts by weight, based on 100 parts by weight of the binder resin. When the amount is less than 0.1 parts by weight, it does not show sufficient performance as toner scum preventives, and when it exceeds 5.0 parts by weight, the adhesion of these additives onto the photoconductor undesirably takes place.

The esteramide amine and/or salts thereof used in Embodiment I(c) of the present invention is internally added as a toner scum preventive for preventing the formation of toner scum on the carrier surface by reducing the surface frictional resistance of the toner.

The esteramide amine is a tertiary amine compound having a carbonyloxy group and an amido group in the molecular structure, the esteramide amine preferably having the following general formula (C-1):

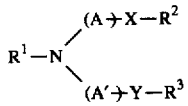

(C-1)

wherein $R^1$ represents an alkyl group, alkenyl group, aralkyl group or hydroxyalkyl group, each having up to 24 carbon atoms; $R^2$ and $R^3$, which may be identical or different, independently represent a hydrogen atom, or an alkyl group or alkenyl group, each having up to 24 carbon atoms; A and A', which may be identical or different, independently represent an alkylene group having 1 to 4 carbon atoms; X represents —NHCO— or —CONH—; and Y represents

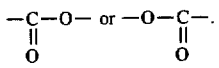

The esteramide amines mentioned above are obtained by the steps of cyanoalkylating an alkylamide, subjecting the cyanoalkylated amide to hydrogenation, hydrolyzing it to give an intermediate, and reacting the thus obtained intermediate with an aliphatic acid to form an ester. Particularly, the following compounds (C-2) to (C-4) are preferred.

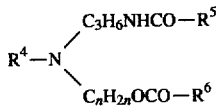

(C-2)

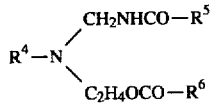

(C-3)

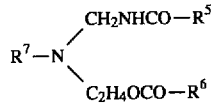

(C-4)

wherein $R^4$ represents an alkyl group having 1 to 4 carbon atoms; $R^5$ and $R^6$, which may be identical or different, independently represent an alkyl group having 11 to 21 carbon atoms; $R^7$ represents an alkyl group having 12 to 22 carbon atoms; and n is equal to 2 or 3.

A particularly preferred example is N-hydroxyethyl-N-methyl propylenediamine-ester amide (HEMPDA-EA). HEMPDA-EA has the following general formula (C-5):

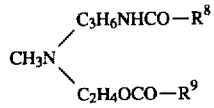

(C-5)

wherein $R^8$ and $R^9$, which may be identical or different, independently represent an alkyl group having 16 to 18 carbon atoms. This HEMPDA-EA can be obtained by the steps of cyanoethylating N-hydroxyethyl-N-methylamine, hydrogenating the cyanoethylated product to give N-hydroxyethyl-N-methyl propylenediamine, and adding an aliphatic acid to the above N-hydroxyethyl-N-methyl propylenediamine to form an ester.

Examples of salts of esteramide amines include a compound obtained by neutralizing the esteramide amine having the general formula (C-1) with an acid and preferably include a compound obtained by neutralizing HEMPDA having the general formula (C-5) with an acid. Examples of salts include hydrochloric salts and quaternary ammonium salts.

The esteramide amine and/or salts thereof can be used singly or in combination of two or more kinds. The esteramide amine and/or salts thereof can be added to the binder resin by a kneading method, which is an internal addition method. By using this method in the present invention, since these esteramide amine and/or salts thereof have good compatibility with the polyester resin, the long-chain alkyl group of these esteramide amine and/or salts thereof appears on the surface of the toner, so that the surface frictional resistance of the obtained toner can be reduced. Accordingly, the formation of toner scum can be prevented.

The amount of the esteramide amine and/or salts thereof is preferably 0.5 to 5.0 parts by weight, particularly 0.7 to 2.0 parts by weight, based on 100 parts by weight of the binder resin. When the amount is less than 0.5 parts by weight, it does not show sufficient performance as toner scum preventives, and when it exceeds 5.0 parts by weight, the adhesion of these additives onto the photoconductor undesirably takes place.

In Embodiment I(d) of the present invention, as a toner scum preventive for preventing the formation of toner scum on the carrier surface by reducing the surface frictional resistance of the toner, the following compound having the general formula (D-1) is internally added:

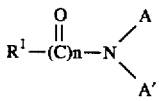

(D-1)

wherein $R^1$ represents an alkyl group, aralkyl group or alkenyl group, each having 7 to 24 carbon atoms; A and A', which may be identical or different, independently represent a hydrogen atom, methyl group or $—CH_2CH_2OR^2$, wherein $R^2$ represents a hydrogen atom, an alkyl group, aralkyl group or alkenyl group, each having 8 to 24 carbon atoms, or

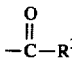

wherein $R^3$ represents an alkyl group, aralkyl group or alkenyl group, each having 8 to 24 carbon atoms; and n is equal to 0 or 1.

Among the compounds having the general formula (D-1) mentioned above, a particular preference is given to the compound wherein at least either of A and A' is $—CH_2CH_2OH$.

Specific examples thereof include ethanol amine-type compounds such as diethanol alkylamine having the following general formula (D-2):

$$R^1—N(C_2H_4OH)_2 \quad \text{(D-2)}$$

wherein $R^1$ is defined in (D-1), whose commercially available products include "ELECTROSTRIPPER ES" ($R^1=C_{18}H_{37}$, powdery) (manufactured by Kao Corporation) and "ELECTROSTRIPPER EA" ($R^1=C_{12}H_{25}$, liquid state) (manufactured by Kao Corporation); and ethanol alkylamine having the following general formula (D-3):

$$R^1—NHC_2H_4OH \quad \text{(D-3)}$$

wherein $R^1$ is defined in (D-1).

Examples of ethanol amide-type compounds include diethanol alkylamide having the following general formula (D-4):

$$R^1—CO—N(C_2H_4OH)_2 \quad \text{(D-4)}$$

wherein $R^1$ is defined in (D-1), whose commercially available products include "AMISOLE-SDE" ($R^1=C_{18}H_{37}$, solid having a melting point of 50° to 60° C.) (manufactured by Kawaken Fine Chemicals) and "AMINONE L02" ($R^1=C_{12}H_{25}$, solid having a melting point of 38° C.) (manufactured by Kao Corporation).

Further, as high-melting point ethanol alkylamides, there have been known to use a mixture of $R^1—N(C_2H_4OH)_2$, $R^1—N(C_2H_4OH)(C_2H_4OCOR^3)$ and $R^1—N(C_2H_4OCOR^3)_2$ ($R^1=C_{16}–C_{18}$ alkyl group, $R^3=C_{15}–C_{17}$ alkyl group, melting point: 50° C., commercially available as "ELECTROSTRIPPER TS-6," manufactured by Kao Corporation) or an amide cation having the following general formula (D-5):

$$[R^1—CONH(CH_2)_3—N^4(CH_3)_2—C_2H_4OH].ClO_4^- \quad \text{(D-5)}$$

wherein $R^1$ is $C_{16}–C_{18}$ alkyl group, commercially available as "ELECTROSTRIPPER V-100" (manufactured by Kao Corporation).

Among the ethanol alkylamines, the ethanol alkylamides and the amide cations thereof mentioned above, those having a melting point of 50° to 160° C., particularly 60° to 100° C. are preferably used.

These compounds having the general formula (D-1) may by used singly or in combination of two or more. The compounds having the general formula (D-1) can be added to the binder resin by a kneading method, which is an internal addition method. By using this method in the present invention, since these compounds having the general formula (D-1) have good compatibility with the polyester resin, the long-chain alkyl group of the compounds having the general formula (D-1) appears on the surface of the toner, so that the surface frictional resistance of the obtained toner can be reduced. Accordingly, the formation of toner scum can be prevented.

The amount of the compounds having the general formula (D-1) is preferably 0.5 to 7.0 parts by weight, particularly 1.0 to 4.0 parts by weight, based on 100 parts by weight of the binder resin. When the amount is less than 0.5 parts by weight, it does not show sufficient performance as toner scum preventives, and when it exceeds 7.0 parts by weight, the adhesion of these additives onto the photoconductor undesirably takes place.

Preferred Embodiment II

Next, Preferred Embodiment II of the present invention will be described in detail below.

The binder resin in Preferred Embodiment II comprises a resin as its main component, which is produced by blending a starting material monomer mixture and concurrently carrying out addition polymerization and condensation polymerization in one reaction vessel. As for the binder resins, the binder resin comprising as its main component a blend of a vinyl resin obtained by addition polymerization (radical polymerization) with a polyester resin, a polyesteramide resin or a polyamide resin obtained by condensation polymerization is preferred. Although the vinyl resins are not particularly limitative, a styrene-acrylic resin is preferred. In the present invention, examples of the most suitable toners include those having a binder resin comprising as the main component a resin prepared by blending a styrene-acrylic resin with a polyester resin.

The binder resin in Embodiment II is prepared by, for instance, blending a starting material monomer mixture and concurrently carrying out addition polymerization and condensation polymerization in one reaction vessel. The starting material monomers, etc. will be detailed below.

In Embodiment II of the present invention, when the vinyl resin is obtained by addition polymerization, the following vinyl resin monomers, crosslinking agents, if necessary, and polymerization initiators such as peroxides and azo compounds are used.

Typical examples of the monomers used for forming the vinyl resins obtained by the addition polymerization include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers of ethylenic monocarboxylic acids such as acrylonitrile, methacrylonitrile and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone. In the present invention, a preference is given to styrene, acrylic acid, methyl acrylate, ethyl acrylate, 2-ethylhexyl acrylate, methacrylic acid, methyl methacrylate, ethyl methacrylate and 2-ethylhexyl methacrylate.

When a crosslinking agent is used, examples of crosslinking agents added include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate. Among them, a preference is given to divinylbenzene and polyethylene glycol dimethacrylate. These crosslinking agents may be used, if necessary, alone or in combination of two or more.

The amount of these crosslinking agents used is 0.001 to 15% by weight, preferably 0.1 to 10% by weight, based on the polymerizable monomers. When the amount of these crosslinking agents used is more than 15% by weight, the resulting toner is unlikely to be melted with heat, thereby resulting in poor heat fixing ability and poor heat-and-pressure fixing ability. On the contrary, when the amount used is less than 0.001% by weight, in the heat-and-pressure fixing, a part of the toner cannot be completely fixed on a paper but rather adheres to the surface of a roller, which in turn is transferred to a subsequent paper, namely an offset phenomenon takes place.

Examples of the polymerization initiators to be used in the production of the vinyl resin include azo and diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

For the purposes of controlling the molecular weight or molecular weight distribution of the polymer or controlling the reaction time, two or more polymerization initiators may be used in combination. The amount of the polymerization initiator used is 0.1 to 20 parts by weight, preferably 1 to 10 parts by weight, based on 100 parts by weight of the monomers to be polymerized.

Further, in Embodiment II, when a polyester is obtained by condensation polymerization, alcohol components and acid components are used as starting material monomers. Specifically, as in the same manner as in Embodiment I, the polyesters can be formed between starting material monomers of a dihydric alcohol or a trihydric or higher alcohol and a dicarboxylic acid or a tricarboxylic or higher polycarboxylic acid, an acid anhydride thereof or an ester thereof.

The alcohol components used in Embodiment II may be the same one as mentioned in Embodiment I. Also, the acid components used in Embodiment II may be the same one as mentioned in Embodiment I.

In the starting material monomers for forming the amide components in the polyester-polyamides or the polyamides which can be obtained by the condensation polymerization, examples of the starting material monomers include polyamines such as ethylenediamine, pentamethylenediamine, hexamethylenediamine, diethylenetriamine, iminobispropylamine, phenylenediamine, xylylenediamine, and triethylenetetramine; amino carboxylic acids such as 6-aminocaproic acid and ε-caprolactam; and amino alcohols such as propanolamine. Among these starting material for forming the amide components, a preference is given to hexamethylenediamine and ε-caprolactam.

The polymerization reaction is, for example, carried out by the method comprising the steps of adding dropwise a mixture comprising a starting material monomer, crosslinking agents and a polymerization initiator for the vinyl resins to a starting material monomer mixture for polyesters, polyester-polyamides, or polyamides under temperature conditions appropriate for the addition polymerization reaction, the condensation polymerization being partly carried out concurrently with the addition polymerization reaction; keeping the temperature of the obtained mixture under said temperature conditions to complete only the addition polymerization reaction; and then raising the reaction temperature to increase degree of the condensation polymerization. Here, although the temperature conditions appropriate for the addition polymerization reaction may vary depending upon the types of the polymerization initiators, they are normally 50° to 180° C., and the optimum temperature for increasing degree of the condensation polymerization is normally 190° to 270° C.

In the concurrent polymerization reactions mentioned above, both of the polymerization reactions do not have to proceed or terminate at the same time, and the reaction temperature and time can be suitably selected so as to proceed or terminate each reaction according to each of the reaction mechanisms.

By the production method described above, the binder resin comprising a blend of the condensation polymerization-type resin selected from the group consisting of polyester resins, polyesteramide resins and polyamide resins with a vinyl resin such as styrene-acrylic resin can be obtained. In this case, the condensation polymerization-type resin and the vinyl resin are preferably blended in a mixing ratio of 10 to 90 parts by weight of the condensation polymerization-type resin to 90 to 10 parts by weight of the vinyl resin.

The binder resin thus obtained preferably has a softening point of 95° to 170° C., more preferably 120° to 160° C., and a glass transition temperature of 50° to 80° C., more preferably 55° to 70° C. The softening point and the glass transition temperature may be easily controlled to the above ranges by adjusting the amounts of the polymerization initiators and the catalysts in the starting material monomer mixture, or by selecting suitable reaction conditions.

Incidentally, in the present invention, when the molecular weight of the resin obtained in either of the reaction paths is designed low, the pulverizability of the obtained binder resin can be improved. Particularly when the number-average molecular weight of the addition polymerization-type resin is not more than 11,000, it is highly effective in improving the pulverizability of the binder resin. In order to easily adjust the number-average molecular weight to not more than 11,000, large amounts of the polymerization initiators may be used, or a chain transfer agent may be used.

In Preferred Embodiment II of the present invention, the binder resin prepared by the method described above contains at least one of the toner scum preventives selected from the group consisting of (a) to (d) mentioned in Preferred Embodiment I.

As in the same manner as in Embodiment I, the toner scum preventive is internally added for the purpose of serving as a toner scum preventive for preventing the formation of toner scum on the surface in addition to the purposes of serving as a releasing agent for preventing offset phenomenon and reducing wear of the photoconductor.

Therefore, examples of the toner scum preventives, amounts of the toner scum preventives, addition method thereof, and the mechanism of their actions are the same as those mentioned in Embodiment I.

The toner scum preventives mentioned above may be used singly or in combination of two or more kinds. As for a method for adding these toner scum preventives to the binder resin, kneading method (internal addition method) may be employed. This is because in this method, the toner scum preventives have good compatibility with the binder resin, so that the surface frictional resistance of the toner can be lowered. Accordingly, the formation of toner scum can be prevented.

The amount of the toner scum preventive added is the same as those mentioned in Preferred Embodiment I. The criticality significance for the amount is also explained similarly.

The toner of the present invention contains the binder resin and various additives thus explained. In both Embodiment I and Embodiment II, the toner further contains a coloring agent as an essential component, together with a charge control agent and, if necessary, other additives such as a free flow agent, a cleanability improver and a releasing agent.

In the present invention, the charge control agents are not particularly limitative, and they may be chosen depending upon whether a positively chargeable toner or a negatively chargeable toner is used. As for the positively chargeable toners, any of positive charge control agents conventionally used for electrophotography and mixtures thereof may be employed. Examples thereof include imidazole derivatives such as "PLZ-2001" (manufactured by Shikoku Kasei K.K.) and "PLZ-8001" (manufactured by Shikoku Kasei K.K.); triphenylmethane derivatives such as "COPY BLUE PR" (manufactured by Hoechst); "Bontron N-07" (manufactured by Orient Chemical Co., Ltd.); quaternary ammonium salt compounds such as "TP-415" (manufactured by Hodogaya Chemical Co., Ltd.), "TP-4040" (manufactured by Hodogaya Chemical Co., Ltd.), "Bontron P-51" (manufactured by Orient Chemical Co., Ltd.), "Copy Charge PX VP435" (manufactured by Hoechst) and cetyltrimethylammonium bromide; polyamine resins such as "AFP-B" (manufactured by Orient Chemical Co., Ltd.); and with a preference given to Bontron N-07, TP-415, TP-4040 and Bontron P-51.

As for negatively chargeable toners, any of negative charge control agents conventionally used for electrophotography and mixtures thereof may be employed. Examples thereof include azo dyes containing metals such as "Varifast Black 3804" (manufactured by Orient Chemical Co., Ltd.), "Bontron S-32" (manufactured by Orient Chemical Co., Ltd.), "Bontron S-34" (manufactured by Orient Chemical Co., Ltd.), "Bontron S-36" (manufactured by Orient Chemical Co., Ltd.), "Aizen Spilon Black T-77" (manufactured by Hodogaya Chemical Co., Ltd.) and "Aizen Spilon Black TRH" (manufactured by Hodogaya Chemical Co., Ltd.); copper phthalocyanine dye; metal complexes of alkyl derivatives of salicylic acid such as "Bontron E-84" (manufactured by Orient Chemical), and "Bontron E-85" (manufactured by Orient Chemical); and quaternary ammonium salt compounds such as "Copy Charge NX VP434" (manufactured by Hoechst), with a preference given to Aizen Spilon Black T-77 and Aizen Spilon Black TRH.

Also, it is also possible to add a charge control agent having a reverse polarity to the main charge control agent. In this case, the reverse charge control agent should be added in an amount of one-half or less that of the main charge control agent, so that a decrease in image density does not take place even after continuous development of not less than 50,000 sheets, thereby making it possible to obtain excellent visualized images.

The charge control agent mentioned above may be added in an amount of preferably 0.1 to 8.0 parts by weight, particularly 0.2 to 5.0 parts by weight, based on 100 parts by weight of the binder resin.

The coloring agents are not particularly limitative, and any of the known ones can be used, including dyes for chromatic color, and pigments such as carbon black for black color and grafted carbon black obtained by coating the surface of carbon black with a resin.

Examples of coloring agents for colors other than black include three primary colors such as yellow, magenta and cyan. Examples of yellow coloring agents include C.I. Solvent Yellow 21, C.I. Solvent Yellow 77, C.I. Pigment Yellow 12, and C.I. Disperse Yellow 164.

Examples of magenta coloring agents include C.I. Solvent Red 49, C.I. Solvent Red 128, C.I. Pigment Red 13, C.I. Pigment Red 48.2 and C.I. Disperse Red 11.

Examples of cyan coloring agents include C.I. Solvent Blue 21, C.I. Solvent Blue 94 and C.I. Pigment Blue 15.3.

These coloring agents are preferably added in an amount of 0.01 to 20% by weight, particularly 1 to 10% by weight, based on the entire amount of toner.

The toner of the present invention may also contain such additives as a free flow agent and a cleanability improver, if necessary.

Examples of the free flow agents include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica. In particular, "R-809" (manufactured by Japan Aerosil Co.) and "HVK-2150" (manufactured by Hoechst Japan Co.) are preferably used.

As for the cleanability improvers, besides the toner scum preventives mentioned above which are internally added to the toner, finely powdered fluorine-based polymers and finely powdered silicone resins may be used, with a preference given to poly vinylidene fluorides such as "KYNAR 461" AND "KYNAR 500" (manufactured by Elf Atochem Japan Co.).

In order not to lower the effects of the toner scum preventives mentioned above, the free flow agent and the cleanability improver are preferably added in an amount of 0.01 to 2.0% by weight, based on the toner.

If necessary, the toner may contain a releasing agent for the purpose of improving the offset resistance in heat roller fixing, and examples of the releasing agents include one or more offset inhibitors such as polyolefins, higher alcohols, paraffin waxes, amide waxes, polyhydric alcohol esters, silicone varnish, aliphatic fluorocarbons and silicone oils besides the above-mentioned aliphatic acids and/or metal salts thereof functioning for the above purpose.

Further, for the purpose of controlling the developability of the toner, finely powdered polymers of methyl methacrylate may be added. Furthermore, for the purposes of controlling the electric resistance or coloring tone of the toner, a small amount of carbon black may be used.

The toner of the present invention can be produced by uniformly blending the above starting materials containing a toner scum preventive with a binder resin, and then kneading, cooling, pulverizing and classifying by known methods. With respect to the particle diameter of the obtained toner, it is normally 6 to 15 μm, preferably 8 to 13 μm, though it may vary depending on the size of the carrier particles. The toners of the present invention may be either positively chargeable ones or negatively chargeable ones.

The developer composition of the present invention comprises the toner described above and a carrier, the toner being carried on the carrier. As for the carrier used in the present invention, the same type of carrier is used for both Embodiment I and Embodiment II. A carrier having a rugged surface is preferably used. More specifically, a carrier comprising an irregular-shaped iron particles having a rugged surface, which is a so-called "sponge," as a core material, its outer surface being coated with a coating material thereon, is preferably used.

Examples of the irregular-shaped iron particles constituting the core include ore-reduced iron particles produced by reducing iron ore; mill scale-reduced iron particles produced by reducing mill scale; spherical atomized iron particles produced by ejecting a steel melt from small nozzles and then cooling and forming into powders; nitrided iron particles obtained by nitriding thin steel pieces, pulverizing the nitrided pieces and subjecting the pulverized powder to denitrification. Among these iron particles, a preference is given to those having a bulk density of 2 to 4 g/cm$^3$ and an average particle diameter of 50 to 200 μm, particularly 55 to 170 μm. Also, it is preferred that the porous, irregular-shaped iron particles having a projecting portion and a concave portion, an average height between the projecting portion and the concave portion being not less than 10 μm.

In the iron particle-type carrier, since the carrier surface is likely to be oxidized by the presence of water in the air to form $Fe_2O_3$ (so-called "rust"), the electric resistance of the carrier can be suitably adjusted by coating the surface with a stable, thin layer having a relatively high resistivity by forced oxidation and adjusting the thickness of the thin layer depending on the degree of treatment.

As for the coating materials for coating the outer surface of the irregular-shaped iron particles, any of the coating materials for carrier which have been conventionally used in electrophotography may be used for the purposes of easily controlling chargeability and retaining long-term durability and charge stability at high temperature and high humidity.

Specific examples of the coating materials include styrene-acrylic resins, polyester resins, polyamide resins, epoxy resins, and other resins having a function for improving surface smoothness such as silicone resins, silicone-acrylic resins and fluoro resins such as various carbon fluoride. Examples of carbon fluorides include homopolymers of vinylidene fluoride, trifluoroethylene, tetrafluoroethylene, hexafluoropropylene, and copolymers thereof. More specifically, examples of copolymerized carbon fluorides include a tetrafluoroethylenehexafluoropropylene copolymer, a vinylidene fluoride-trifluoroethylene copolymer and a vinylidene fluoride-tetrafluoropropylene copolymer, with a preference given to fluoro resins obtained using tetrafluoroethylene or vinylidene fluoride as a monomer.

Also, in order to improve the electric properties and wear resistance of the coating materials, the above fluoro resins may be mixed with inorganic fine particles of alumina, graphite, molybdenum disulfide, or bronze. These fine particles can be burned and bound to the fluoro resin complex at a temperature near the melting point of the fluoro resin. Further, in order to increase adhesion strength of the above fluoro resin to the surface of the irregular-shaped iron particles and provide the carrier with good durability, polyamide resins or epoxy resins may be blended.

The coating can be carried out by the steps of dispersing the above resins in a dispersion medium such as methyl ethyl ketone and tetrahydrofuran; immersing the above carrier in this dispersion liquid or spraying this dispersion liquid on a carrier surface; thermally hardening the coated surface at a temperature of from 150° C. to 300° C. The amount of coating material is, on a dry basis, preferably 0.5 to 10% by weight, particularly 1 to 5% by weight, based on the weight of the carrier.

The toner of the present invention is applicable not only to carriers comprising porous, irregular-shaped iron particles having a rugged surface but also to spherical carriers having a rugged surface made of iron, magnetite or ferrite. Even in the case where spherical carriers are used, the formation of toner scum on the surface of the spherical carriers can be prevented.

The developer composition of the present invention can be prepared by blending the thus coated carrier with the above toner. The mixing weight ratio of the carrier to the toner (carrier/toner) is normally 90/10 to 98/2, preferably 93/7 to 97/3.

EXAMPLES

The present invention will be further described by means of the following working examples, without intending to restrict the scope of the present invention thereto. Production examples of binder resins and production examples of suitable coat carriers used in the present invention are given below together with the working examples.

Resin Production Example 1

740 g of polyoxypropylene(2.2)-2,2-bis(4-hydroxyphenyl)propane, 300 g of polyoxyethylene(2.2)-2,2-bis(4-hydroxyphenyl)propane, 466 g of dimethyl terephthalate, 80 g of isododecenyl succinic anhydride, 114 g of tri-n-butyl 1,2,4-benzenetricarboxylate, and a conventional catalyst used for esterification are placed in a two-liter four-neck glass flask equipped with a thermometer, a stainless steel stirring rod, a reflux condenser and a nitrogen inlet tube. The reaction is proceeded by heating the contents in a mantle heater in a nitrogen gas stream at 220° C. and at normal pressure for the first half of the course of reaction, and at 220° C. and at a reduced pressure for the second half of the course of reaction, while stirring the contents.

The obtained polyester resin has an acid value of 2.8 KOH mg/g, a hydroxyl value of 28.0 KOH mg/g, and a softening point of 138.7° C. as determined by "koka-type" flow tester. This obtained resin is referred to as "Binder Resin (1)."

Resin Production Example 2

551 g of polyoxypropylene(2.2)-2,2-bis(4-hydroxyphenyl)propane, 463 g of polyoxyethylene(2.2)-2,2-bis(4-hydroxyphenyl)propane, 191 g of fumaric acid, 189 g of 1,2,4-benzenetricarboxylic acid, and 3 g of dibutyltin oxide are placed in a three-liter four-neck glass flask equipped with a thermometer, a stainless steel stirring rod, a reflux condenser and a nitrogen inlet tube. The reaction is proceeded by heating the contents in a mantle heater in a nitrogen gas stream at 220° C. and at normal pressure for the first half of the course of reaction, and at 220° C. and at a reduced pressure for the second half of the course of reaction, while stirring the contents.

The degree of polymerization is monitored from a softening point measured by the method according to ASTM E 28-51T, and the reaction is terminated when the softening point reaches 137° C.

The obtained polyester resin has an acid value of 20.4 KOH mg/g, and a hydroxyl value of 21.0 KOH mg/g. This obtained resin is referred to as "Binder Resin (2)."

Resin Production Example 3

700 g of styrene and 300 g of n-butyl methacrylate as monomers for forming vinyl resins, and 50 g of dicumyl peroxide as a polymerization initiator are placed into a dropping funnel.

390 g of polyoxypropylene(2.2)-2,2-bis(4-hydroxyphenyl)propane, 120 g of isophthalic acid, 38 g of 1,2,5-benzenetricarboxylic acid, and 1 g of dibutyltin oxide are placed in a five-liter four-neck glass flask equipped with a thermometer, a stainless steel stirring rod, a reflux condenser and a nitrogen inlet tube. To the mixture contained in the glass flask, the mixture comprising the monomers for forming the vinyl resins, and the polymerization initiator is added dropwise from the above dropping funnel over a period of 4 hours while heating the contents at 135° C. in a mantle heater in a nitrogen gas atmosphere and stirring the contents. The reaction mixture is matured for 5 hours while keeping the temperature at 135° C., and then the temperature is elevated to 220° C. to react the components.

The degree of polymerization is monitored from a softening point measured by the method according to ASTM E 28-67, and the reaction is terminated when the softening point reaches 130° C.

The obtained resin is a pale yellow solid, which has a glass transition temperature determined by a differential scanning calorimeter (hereinafter abbreviated as "DSC") with a single peak at 62° C. As indicated from above, since it has a single peak, the dispersion state of the resins is good. This obtained resin is referred to as "Binder Resin (3)."

Resin Production Example 4

820 g of styrene and 180 g of 2-ethylhexyl acrylate as monomers for forming vinyl resins, and 40 g of azobisisobutyronitrile as a polymerization initiator are placed into a dropping funnel.

390 g of polyoxypropylene(2.2)-2,2-bis(4-hydroxyphenyl)propane, 12 g of fumaric acid, 55 g of isododecenyl succinic anhydride, 110 g of terephthalic acid, and 1 g of dibutyltin oxide are placed in a five-liter four-neck glass flask equipped with a thermometer, a stainless steel stirring rod, a reflux condenser and a nitrogen inlet tube. The subsequent procedures are carried out under the same polymerization conditions as in Resin Production Example 3.

The glass transition temperature of the obtained resin is determined by DSC. As a result, it shows a single peak at 60° C. As indicated from above, the dispersion state of the resins is good as the resin obtained in Resin Production Example 3. This obtained resin is referred to as "Binder Resin (4)."

Example 1-1

| | |
|---|---|
| Binder Resin (1) | 87 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Zinc Stearate "S-Z" (Manufactured by Nippon Oil and Fats Co., Ltd.) | 3 parts by weight |

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 1-1 having an average particle diameter of 11 μm.

Example 1-2

The same procedures as in Example 1-1 are carried out except that 3 parts by weight of zinc stearate "S—Z" (manufactured by Nippon Oil and Fats Co., Ltd.) are replaced with 1 part by weight of zinc stearate "SZ-DF-2" (manufactured by Sakai Chemical Industry Co., Ltd.), to give a positively chargeable toner 1-2.

Example 1-3

The same procedures as in Example 1-1 are carried out except that 3 parts by weight of zinc stearate "S—Z" (manufactured by Nippon Oil and Fats Co., Ltd.) are replaced with 3 parts by weight of lithium stearate "S-7000" (manufactured by Sakai Chemical Industry Co., Ltd.), to give a positively chargeable toner 1-3.

Example 1-4

The same procedures as in Example 1-1 are carried out except that 3 parts by weight of zinc stearate "S—Z" (manufactured by Nippon Oil and Fats Co., Ltd.) are replaced with 1 part by weight of aluminum stearate "SA-1000" (manufactured by Sakai Chemical Industry Co., Ltd.), to give a positively chargeable toner 1-4.

Example 1-5

| | |
|---|---|
| Binder Resin (2) | 90 parts by weight |
| Carbon Black "REGAL 400R" (Manufactured by Cabot Corporation) | 8 parts by weight |
| Negative Charge Control Agent "AIZEN SPILON BLACK T-77" (Manufactured by Hodogaya Chemical Co., Ltd.) | 1.5 parts by weight |
| Stearic Acid "LUNAC S-90" (Manufactured by Kao Corporation) | 0.5 parts by weight |

Using the above starting materials, the same procedures as in Example 1-1 are carried out, to give a negatively chargeable toner 1-5 having an average particle diameter of 11 μm.

Comparative Example 1

The same procedures as in Example 1-1 are carried out except that 3 parts by weight of zinc stearate "S—Z" (manufactured by Nippon Oil and Fats Co., Ltd.) are not added and that the amount of binder resin (1) is changed to 90 parts by weight, to give a positively chargeable comparative toner 1.

Comparative Example 2

0.3 parts by weight of zinc stearate "SZ-DF-2F" (product having a particle diameter of 3 μm, manufactured by Sakai Chemical Industry Go., Ltd.) are externally added to 100 parts by weight of the toner obtained in Comparative Example 1, and mixed with Henschel mixer to adhere zinc stearate onto the surface of the toner. A positively chargeable comparative toner 2 is thus obtained.

Example 2-1

| | |
|---|---|
| Binder Resin (1) | 88.5 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Monoalkyl Phosphate "MAP-60H" (Manufactured by Kao Corporation)* | 1.5 parts by weight |

*: "MAP-60H" is a monoalkyl phosphate having the above-mentioned general formula (B-1) wherein $R^1 = C_{16}H_{33}$, $n = n' = 0$).

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 2-1 having an average particle diameter of 11 μm.

Example 2-2

The same procedures as in Example 2-1 are carried out except that 1.5 parts by weight of the monoalkyl phosphate are replaced with 1.5 parts by weight of dialkyl phosphate "DAP-60H" (manufactured by Kao Corporation), to give a positively chargeable toner 2-2.

"DAP-60H" is a dialkyl phosphate having the above-mentioned general formula (B-2) wherein $R^2=R^3=C_{16}H_{33}$ and m=0.

Example 2-3

The same procedures as in Example 2-1 are carried out except that the monoalkyl phosphate is replaced with 1.5 parts by weight of dialkyl phosphate "FAMEX P-18" (manufactured by Ajinomoto Co., Inc.), to give a positively chargeable toner 2-3.

"FAMEX P-18" is a dialkyl phosphate having the above-mentioned general formula (B-2) wherein $R^2=R^3=C_{18}H_{37}$ and m=0.

Example 3-1

| | |
|---|---|
| Binder Resin (1) | 88.2 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Esteramide Amine "HEMPDA-EA" (Manufactured by Kao Corporation)** | 1.8 parts by weight |

**: HEMPDA-EA, having the above-mentioned general formula (C-5), is available for industrial use as a composition having a melting point of 63° C. and decomposable at a temperature of not less than 240° C., which contains 80–84% by weight of esteramide amine having the general formula (C-5), 12–15% by weight of an intermediate (monoamide) and 4.6–5% by weight of an aliphatic acid (C18: 55%, C16:45%).

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 3-1 having an average particle diameter of 11 μm.

Example 3-2

The same procedures as in Example 3-1 are carried out except that 1.8 parts by weight of esteramide amine are replaced with 1.8 parts by weight of esteramide ammonium chloride "HEMPDA-EA-HCl" (80% purity), to give a positively chargeable toner 3-2.

"HEMPDA-EA-HCl" has the following formula:

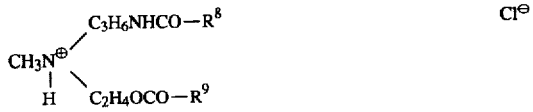

wherein $R^8$ and $R^9$, which may be identical or different, independently represent an alkyl group having 16 to 18 carbon atoms.

Example 4-1

| | |
|---|---|
| Binder Resin (1) | 88.5 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Diethanol stearylamide "AMISOLE SDE" (manufactured by Kawaken Fine Chemical Co., Ltd.) | 1.5 parts by weight |

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 4-1 having an average particle diameter of 11 μm.

Example 4-2

The same procedures as in Example 4-1 are carried out except that 1.5 parts by weight of "AMISOLE SDE" are replaced with 1.5 parts by weight of diethanol stearylamide "ELECTROSTRIPPER ES" (manufactured by Kao Corporation), to give a positively chargeable toner 4-2.

Example 5-1

| | |
|---|---|
| Binder Resin (3) | 87 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Zinc stearate "S-Z" (Manufactured by Nippon Oil and Fats Co., Ltd.) | 3 parts by weight |

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 5-1 having an average particle diameter of 11 μm.

Example 5-2

The same procedures as in Example 5-1 are carried out except that 3 parts by weight of zinc stearate "S—Z" (manufactured by Nippon Oil and Fats Co., Ltd.) are replaced with 1 part by weight of zinc stearate "SZ-DF-2" (manufactured by Sakai Chemical Industry co., Ltd.), to give a positively chargeable toner 5-2.

Example 5-3

The same procedures as in Example 5-1 are carried out except that 3 parts by weight of zinc stearate "S—Z" (manufactured by Nippon Oil and Fats Co., Ltd.) are replaced with 3 parts by weight of magnesium stearate "SM-1000" (manufactured by Sakai Chemical Industry Co., Ltd.) to give a positively chargeable toner 5-3.

Example 5-4

The same procedures as in Example 5-1 are carried out except that 3 parts by weight of zinc stearate "S—Z" (manufactured by Nippon Oil and Fats Co., Ltd.) are replaced with 1 part by weight of aluminum stearate "SA-1000" (manufactured by Sakai Chemical Industry Co., Ltd.), to give a positively chargeable toner 5-4.

Example 5-5

| | |
|---|---|
| Binder Resin (4) | 90 parts by weight |
| Carbon Black "REGAL 400R" (Manufactured by Cabot Corporation) | 8 parts by weight |
| Negative Charge Control Agent "AIZEN SPILON BLACK T-77" (Manufactured by Hodogaya Chemical Co., Ltd.) | 1.5 parts by weight |
| Stearic Acid "LUNAC S-90" (Manufactured by Kao Corporation) | 0.5 parts by weight |

Using the above starting materials, the same procedures as in Example 5-1 are carried out, to give a negatively chargeable toner 5-5 having an average particle diameter of 11 μm.

Comparative Example 3

The same procedures as in Example 5-1 are carried out except that 3 parts by weight of zinc stearate "S—Z" (manufactured by Nippon Oil and Fats Co., Ltd.) are not added and that the amount of binder resin (3) is changed to 90 parts by weight, to give a positively chargeable comparative toner 3.

Comparative Example 4

0.3 parts by weight of zinc stearate "SZ-DF-2F" (product having a particle diameter of 3 μm, manufactured by Sakai Chemical Industry Co., Ltd.) are externally added to 100 parts by weight of the toner obtained in Comparative Example 3, and mixed with Henschel mixer to adhere zinc stearate onto the surface of the toner. A positively chargeable comparative toner 4 is thus obtained.

Example 6-1

| | |
|---|---|
| Binder Resin (3) | 88.5 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Monoalkyl Phosphate "MAP-60H" | 1.5 parts by |

-continued

| (manufactured by Kao Corporation)* | weight |
|---|---|

*: MAP-60H is a monoalkyl phosphate having the above-mentioned general formula (B-1) wherein $R^1 = C_{16}H_{33}$, n = n' = 0).

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 6-1 having an average particle diameter of 11 μm.

Example 6-2

| | |
|---|---|
| Binder Resin (3) | 89.5 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Quaternary Compound of Long chain Aliphatic Acid Amide Amine "ELECTROSTRIPPER V-100"* (Manufactured by Kao Corporation) | 0.5 parts by weight |

*"ELECTROSTRIPPER V-100" is an amide cation having the general formula (D-5) wherein $R^1$ is $C_{16}$–$C_{18}$ alkyl group.

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 6-2 having an average particle diameter of 11 μm.

Example 6-3

| | |
|---|---|
| Binder Resin (3) | 88.2 parts by weight |
| Carbon Black "REGAL 330R" (Manufactured by Cabot Corporation) | 7 parts by weight |
| Positive Charge Control Agent "BONTRON N-07" (Manufactured by Orient Chemical Co., Ltd.) | 2 parts by weight |
| Positive Charge Control Agent "TP-415" (Manufactured by Hodogaya Chemical Co., Ltd.) | 1 part by weight |
| Esteramide Amine "HEMPDA-EA"** (Manufactured by Kao Corporation) | 1.8 parts by weight |

**HEMPDA-EA, having the above-mentioned general formula (C-5), is available for industrial use as a composition having a melting point of 63° C. and decomposable at a temperature of not less than 240° C., which contains 80–84% by weight of esteramide amine having the general formula (C-5), 12–15% by weight of an intermediate (monoamide) and 4.6–5% by weight of an aliphatic acid (C18: 55%, C16:45%).

The above starting materials are blended well using Henschel mixer, and the mixture is kneaded and cooled using a twin-screw extruder equipped with a Barrel cooling system. The obtained mixture is roughly pulverized, and the roughly pulverized mixture is finely pulverized using a jet mill. The obtained finely pulverized powder is classified using an air classifier, to give a positively chargeable toner 6-3 having an average particle diameter of 11 μm.

Production Example 1 of Coat Carrier

A dispersion mixture comprising 50 parts by weight of a vinylidene fluoride-tetrafluoroethylene copolymer ["VT50" (manufactured by Daikin Industries, Ltd.), copolymeric molar ratio is 80:20] and 20 parts by weight of an epoxy resin ["EPICOAT 1001" (manufactured by Mitsubishi Petrochemical Co., Ltd.)] dispersed in 1000 parts by weight of methyl ethyl ketone are previously prepared. The above dispersion mixture is spray-coated onto the surface of 1000 parts by weight of conductive graphite-filled sponge iron powders "COPY POWDER CS105-175" (manufactured by Hoeganäs AB) having an average diameter of 160 μm using a tumbling fluidized bed-type coating apparatus so as to have 1 part by weight of the dispersion mixture remain as a coated layer. The coated powders are dried and then heat-treated in an electric furnace at 200° C. for 30 minutes, to give a coat carrier 1.

Production Example 2 of Coat Carrier

The same procedures as in Production Example 1 of Coat Carrier are carried out except that the vinylidene fluoride-tetrafluoroethylene copolymer "VT50" (manufactured by Daikin Industries, Ltd.) and the epoxy resin "EPICOAT 1001" (manufactured by Mitsubishi Petrochemical Co., Ltd.) in Production Example 1 of Coat Carrier are replaced with a straight silicone resin "KR-271" (manufactured by Shin-Etsu Chemical Co., Ltd.), to give a coat carrier 2.

Test Example 1

A positively chargeable developer is prepared by blending 3 parts by weight of each of the toners obtained in Examples 1-1, 1-2, 1-3, 1-4, Comparative Examples 1 or 2 with 100 parts by weight of coat carrier 1, and a negatively chargeable developer is prepared by blending 3 parts by weight of Toner 1-5 obtained in Example 1-5 with 100 parts by weight of coat carrier 2.

Each of the developers obtained above is loaded on a modified apparatus of a commercially available copying machine ("FX 1075," manufactured by Fuji Xerox Co., Ltd.) equipped with an organic photoconductive (OPC) belt, and fixing ability tests are conducted by reverse development for the positively chargeable developers and by normal development for the negatively chargeable developer. Further, a long-time durability test for 1,000,000 sheets under the normal environmental conditions (23° C., 50% RH) is carried out. The tribo electric charge of developers, the carrier resistance, the formed images and the toner scum on the surface of the carrier observed by FE/SEM (manufactured by JEOL, Ltd. (Nihon Denshi Kabushiki Kaisha)) are evaluated by the following methods.

(1) Evaluation of Tribo Electric Charge:

The apparatus used for evaluating the tribo electric charge is a blow-off type electric charge measuring device, which is a specific charge measuring device equipped with a Faraday cage, a capacitor and an electrometer.

The measurement is conducted as follows: W (g) (about 3.0 g) of the developer taken out of the developer vessel is placed into a brass measurement cell having a stainless screen of 325 mesh, which is adjustable to any mesh size to block the passage of the carrier particles. Next, aspiration from a suction opening is carried out for 90 seconds under a pressure giving a flow meter value of 3 liters/minute, thereby selectively removing only the toner from the cell.

Here, the voltage of the electrometer after 90 seconds from the start of blowing is defined as V (volt). Here, when the electric capacitance of the capacitor is defined as C (μF), a specific charge Q/m of this toner can be calculated by the following equation:

$$Q/m\ (\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100 (%), and m can be calculated as shown in the following equation:

$$m(g)=W\times(T/D)$$

The results are shown in Table 1.

(2) Evaluation of Carrier Resistance:

The carrier remaining on the stainless mesh in the blow-off type tribo electric charge measuring device is placed into a cell for the dynamic carrier resistance measuring device ("C-meter", manufactured by Epping GmbH) with a measuring spoon attached thereto in an amount of 1 cc, and the dynamic carrier resistance is measured using a capacitor with an electric capacitance of 10000 pF at a magnetization force of 630 Gauss, and an applied voltage of 12 V after preactivating for 63 seconds.

The results are shown in Table 1.

(3) Evaluation of Formed Images:

The evaluation of formed images is conducted with respect to image density and background by the following method.

The image density is evaluated by the measured values obtained by Macbeth reflective densitometer "RD-914" (manufactured by Macbeth Process Measurements Co.).

The background is evaluated by using a color meter for measuring degree of whiteness "Z-1001Dp" (manufactured by Nippon Denshoku Kogyo Kabushiki Kaisha). This is evaluated by a relative value obtained by subtracting the degree of whiteness obtained in the non-image forming portion of the recording paper after development from the degree of whiteness obtained in an unused paper.

The results are shown in Table 1.

(4) Evaluation of Fixing Ability:

The fixing ability is evaluated by the method as described below. Specifically, each of the developers prepared as described above is loaded on the copy machine described above without applying silicone oil to the fixing portion of the copy machine to develop images. The copy machine is modified such that the roller temperature can be made variable. By controlling the fixing temperature from 120° C. to 240° C., the lowest fixing temperature and the offset resistance during forming fixed images are evaluated.

The lowest fixing temperature used herein is the temperature of the fixing roller at which the fixing ratio of the toner exceeds 70%. This fixing ratio of the toner is determined by placing a load of 500 g on a sand rubber eraser (LION No. 502) having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the erased image with a reflective densitometer "RD-914" (manufactured by Macbeth Process Measurements Co.), and then calculating the fixing ratio from this density value and a density value before the eraser treatment using the following equation.

$$\text{Fixing ratio (\%)} = \frac{\text{Image density after eraser treatment}}{\text{Image density before eraser treatment}} \times 100$$

(5) Presence of Toner Scum on Carrier Surface:

After conducting copying 1,000,000 sheets using the above copying machine, the carrier is taken out from the developer, the toner thereon is removed to determine whether a toner scum takes place by observing the projecting portion of the carrier by scanning electron microscope.

The results are shown in Table 1.

With regard to the fixing ability, it is found that in all of toners mentioned above, fixing can be achieved at a fixing temperature of not more than 180° C., which is a desired lowest fixing temperature, and that no offset image is generated even at 240° C. Therefore, the results of evaluation are not incorporated in the table.

TABLE 1

| | Tribo Electric Charge | | Carrier Resistance | | Image Density | | Background | | Presence of Toner Scum |
|---|---|---|---|---|---|---|---|---|---|
| | At Start | After Copying 1,000,000 Sheets | At Start | After Copying 1,000,000 Sheets | At Start | After Copying 1,000,000 Sheets | At Start | After Copying 1,000,000 Sheets | (After Copying 1,000,000 Sheets) |
| Example 1-1 | +21.4 | +22.0 | 8.63 | 8.67 | 1.41 | 1.39 | 0.08 | 0.13 | None |
| Example 1-2 | +20.4 | +21.2 | 8.58 | 8.68 | 1.45 | 1.38 | 0.11 | 0.20 | None |
| Example 1-3 | +22.0 | +22.4 | 8.71 | 8.79 | 1.42 | 1.38 | 0.07 | 0.14 | None |
| Example 1-4 | +21.7 | +21.1 | 8.62 | 8.74 | 1.42 | 1.38 | 0.10 | 0.19 | None |
| Example 1-5 | −20.9 | −22.9 | 8.60 | 8.71 | 1.40 | 1.37 | 0.13 | 0.22 | None |
| Comparative Example 1 | +23.6 | +12.1 | 8.73 | Not Determined | 1.34 | 0.51 | 0.32 | 1.67 | Present in All Carriers |
| Comparative Example 2 | +18.9 | +4.1 | 8.18 | 7.1 | 1.43 | 1.51 | 0.40 | 3.81 | Present Partially in Carriers |

As is clear from Table 1, in the case of using the toner obtained in Comparative Example 1 where no stearic acid or salts thereof is added, the tribo electric charge is halved, and the carrier resistance is undesirably increased to a level at which no measurements can be taken, so that the developer shows drastically poor performance. This can be verified by the facts that the image density is reduced to about a half of that at start, that the background is increased, and that the toner scum is generated.

Also, in the case of using the toner obtained in Comparative Example 2 where zinc stearate is externally added, the tribo electric charge is drastically reduced, and the background is drastically increased although the image density is not significantly reduced. The reasons for such undesirable properties may be presumably as follows: An insulating layer is formed on the surface of the photoconductor because zinc stearate adhered on the toner gradually shifts to the photoconductor side during the transfer process. Also, since the fluidity of the developer is improved due to the zinc stearate detached from the toner, the contact between the carriers become too strong, thereby causing a bias leakage.

On the other hand, in cases of using toners obtained in Examples 1-1 to 1-5, it is found that the developers show long service life by showing good performance after copying 1,000,000 sheets while satisfying the desired low-temperature fixing ability, and that the formation of toner scum on carriers can be well prevented.

The reasons for having such a good performance in the toners of the present invention may be presumably as follows: When compared with the toner obtained by conventional external addition methods as in Comparative Example 2, the toners of the present invention have more uniform dispersion. Moreover, since the aliphatic acid and/or metal salts thereof is rather strongly combined to the toner, the detachment of these compounds from the toner in the transfer process can be prevented.

Test Example 2

A positively chargeable developer is prepared by blending 3 parts by weight of each of the toners obtained in Examples 2-1, 2-2 or 2-3 with 100 parts by weight of coat carrier 1.

Each of the developers obtained above is loaded on a modified apparatus of a commercially available copy machine ("FX 1075," manufactured by Fuji Xerox Co., Ltd.) equipped with an organic photoconductive (OPC) belt, and the long-time durability test is conducted under the same conditions as in Test Example 1. The tribo electric charge of developers, the carrier resistance, the formed images and the toner scum on the surface of the carrier observed by FE/SEM (manufactured by JEOL, Ltd. (Nihon Denshi Kabushiki Kaisha)) are evaluated in the same manner as in Test Example 1.

The results are shown in Table 2.

With regard to the fixing ability, it is found that in all of toners mentioned above, fixing can be achieved at a fixing temperature of not more than 180° C., which is a desired lowest fixing temperature, and that no offset image is generated even at 240° C. Therefore, the results of evaluation are not incorporated in the table.

The test results obtained in Test Example 1 for comparative toners 1 and 2 are also incorporated in the table.

TABLE 2

| | Tribo Electric Charge | | Carrier Resistance | | Image Density | | Background | | Presence of Toner Scum |
|---|---|---|---|---|---|---|---|---|---|
| | At Start | After Copying 1,000,000 Sheets | At Start | After Copying 1,000,000 Sheets | At Start | After Copying 1,000,000 Sheets | At Start | After Copying 1,000,000 Sheets | (After Copying 1,000,000 Sheets) |
| Example 2-1 | +19.7 | +18.8 | 8.59 | 8.69 | 1.44 | 1.49 | 0.21 | 0.26 | None |
| Example 2-2 | +20.1 | +19.3 | 8.64 | 8.69 | 1.43 | 1.44 | 0.18 | 0.25 | None |
| Example 2-3 | +22.2 | +21.0 | 8.70 | 8.82 | 1.39 | 1.42 | 0.13 | 0.20 | None |
| Comparative Example 1 | +23.6 | +12.1 | 8.73 | Not Determined | 1.34 | 0.51 | 0.32 | 1.67 | Present in All Carriers |
| Comparative Example 2 | +18.9 | +4.1 | 8.18 | 7.1 | 1.43 | 1.51 | 0.40 | 3.81 | Present Partially in Carriers |

As is clear from Table 2, as mentioned above, in the case of using the toner obtained in Comparative Example 1 where no toner scum preventives are added, the tribo electric charge is halved, and the carrier resistance is undesirably increased to a level at which no measurements can be taken, so that the developer shows drastically poor performance. This can be verified by the facts that the image density reduced to about a half of that at start, that the background is increased, and that the toner scum is generated.

Also, in the case of using the toner obtained in Comparative Example 2 where zinc stearate is externally added as a toner scum preventive, the tribo electric charge is drastically reduced, and the background is drastically increased although the image density is not significantly reduced.

On the other hand, in cases of using toners obtained in Examples 2-1 to 2-3, it is found that the developers show long service life with good performance after copying 1,000,000 sheets while satisfying the desired low-temperature fixing ability, and that the formation of toner scum on carriers can be well prevented.

The reasons for having such a good performance in the toners of the present invention may be presumably as follows: The monoalkyl phosphates or the dialkyl phosphates have the function of reducing surface frictional resistance of the toner, since the long-chain alkyl group of the monoalkyl phosphates or the dialkyl phosphates appears on the surface of the toner. As a result, the toner is unlikely to be adhered onto the carrier surface.

Test Example 3

A positively chargeable developer is prepared by blending 3 parts by weight of each of the toners obtained in Examples 3-1 or 3-2 with 100 parts by weight of coat carrier 1.

Each of the developers obtained above is loaded on a modified apparatus of a commercially available copy machine ("FX 1075," manufactured by Fuji Xerox Co., Ltd.) equipped with an organic photoconductive (OPC) belt, and the long-time durability test is conducted under the same conditions as in Test Example 1. The tribo electric charge of developers, the carrier resistance, the formed images and the toner scum on the surface of the carrier observed by FE/SEM (manufactured by JEOL, Ltd. (Nihon Denshi Kabushiki Kaisha)) are evaluated in the same manner as in Test Example 1.

The results are shown in Table 3.

With regard to the fixing ability, it is found that in all of toners mentioned above, fixing can be achieved at a fixing temperature of not more than 180° C., which is a desired lowest fixing temperature, and that no offset image is generated even at 240° C. Therefore, the results of evaluation are not incorporated in the table.

The test results obtained in Test Example 1 for comparative toners 1 and 2 are also incorporated in the table.

TABLE 3

| | Tribo Electric Charge | | Carrier Resistance | | Image Density | | Background | | Presence of Toner Scum |
|---|---|---|---|---|---|---|---|---|---|
| | At Start | After Copying 1,000,000 Sheets | At Start | After Copying 1,000,000 Sheets | At Start | After Copying 1,000,000 Sheets | At Start | After Copying 1,000,000 Sheets | (After Copying 1,000,000 Sheets) |
| Example 3-1 | +20.1 | +19.2 | 8.61 | 8.69 | 1.41 | 1.43 | 0.23 | 0.28 | None |
| Example 3-2 | +22.0 | +21.2 | 8.54 | 8.71 | 1.39 | 1.42 | 0.19 | 0.24 | None |
| Comparative Example 1 | +23.6 | +12.1 | 8.73 | Not Determined | 1.34 | 0.51 | 0.32 | 1.67 | Present in All Carriers |
| Comparative Example 2 | +18.9 | +4.1 | 8.18 | 7.1 | 1.43 | 1.51 | 0.40 | 3.81 | Present Partially in Carriers |

As is clear from Table 3, as mentioned above, in the case of using the toner obtained in Comparative Example 1 where no toner scum preventives are added, the tribo electric charge is halved, and the carrier resistance is undesirably increased to a level at which no measurements can be taken, so that the developer shows drastically poor performance. This can be verified by the facts that the image density is reduced to about a half of that at start, that the background is increased, and that the toner scum is generated.

Also, in the case of using the toner obtained in Comparative Example 2 where zinc stearate is externally added as a toner scum preventive, the tribo electric charge is drastically reduced, and the background is drastically increased although the image density is not significantly reduced.

On the other hand, in cases of using toners obtained in Examples 3-1 and 3-2, it is found that the developers show long service life with good performance after copying 1,000,000 sheets while satisfying the desired low-temperature fixing ability, and that the formation of toner scum on carriers can be well prevented.

The reasons for having such a good performance in the toners of the present invention may be presumably as follows: The esteramines and/or the salts thereof have the function of reducing surface frictional resistance of the toner, since the long-chain alkyl group of the esteramines and/or the salts thereof appears on the surface of the toner. As a result, the toner is unlikely to be adhered onto the carrier surface.

Test Example 4

A positively chargeable developer is prepared by blending 3 parts by weight of each of the toners obtained in Examples 4-1 or 4-2 with 100 parts by weight of coat carrier 1.

Each of the developers obtained above is loaded on a modified apparatus of a commercially available copy machine ("FX 1075," manufactured by Fuji Xerox Co., Ltd.) equipped with an organic photoconductive (OPC) belt, and the long-time durability test is conducted under the same conditions as in Test Example 1. The tribo electric charge of developers, the carrier resistance, the formed images and the toner scum on the surface of the carrier observed by FE/SEM (manufactured by JEOL, Ltd. (Nihon Denshi Kabushiki Kaisha)) are evaluated in the same manner as in Test Example 1.

The results are shown in Table 4.

With regard to the fixing ability, it is found that in all of toners mentioned above, fixing can be achieved at a fixing temperature of not more than 180° C., which is a desired lowest fixing temperature, and that no offset image is generated even at 240° C. Therefore, the results of evaluation are not incorporated in the table.

The test results obtained in Test Example 1 for comparative toners 1 and 2 are also incorporated in the table.

TABLE 4

| | Tribo Electric Charge | | Carrier Resistance | | Image Density | | Background | | Presence of Toner Scum |
|---|---|---|---|---|---|---|---|---|---|
| | At Start | After Copying 1,000,000 Sheets | At Start | After Copying 1,000,000 Sheets | At Start | After Copying 1,000,000 Sheets | At Start | After Copying 1,000,000 Sheets | (After Copying 1,000,000 Sheets) |
| Example 4-1 | +19.8 | +18.9 | 8.52 | 8.63 | 1.43 | 1.44 | 0.18 | 0.24 | None |
| Example 4-2 | +20.0 | +18.8 | 8.61 | 8.68 | 1.41 | 1.44 | 0.23 | 0.31 | None |
| Comparative Example 1 | +23.6 | +12.1 | 8.73 | Not Determined | 1.34 | 0.51 | 0.32 | 1.67 | Present in All Carriers |

TABLE 4-continued

| | Tribo Electric Charge | | Carrier Resistance | | Image Density | | Background | | Presence of Toner Scum |
|---|---|---|---|---|---|---|---|---|---|
| | At Start | After Copying 1,000,000 Sheets | At Start | After Copying 1,000,000 Sheets | At Start | After Copying 1,000,000 Sheets | At Start | After Copying 1,000,000 Sheets | (After Copying 1,000,000 Sheets) |
| Comparative Example 2 | +18.9 | +4.1 | 8.18 | 7.1 | 1.43 | 1.51 | 0.40 | 3.81 | Present Partially in Carriers |

As is clear from Table 4, as mentioned above, in the case of using the toner obtained in Comparative Example 1 where no toner scum preventives are added, the tribo electric charge is halved, and the carrier resistance is undesirably increased to a level at which no measurements can be taken, so that the developer shows drastically poor performance. This can be verified by the facts that the image density is reduced to about a half of that at start, that the background is increased, and that the toner scum is generated.

Also, in the case of using the toner obtained in Comparative Example 2 where zinc stearate is externally added as a toner scum preventive, the tribo electric charge is drastically reduced, and the background is drastically increased although the image density is not significantly reduced.

On the other hand, in cases of using toners obtained in Examples 4-1 and 4-2, it is found that the developers show long service life with good performance after copying 1,000,000 sheets while satisfying the desired low-temperature fixing ability, and that the formation of toner scum on carriers can be well prevented.

The reasons for having such a good performance in the toners of the present invention may be presumably as follows: The ethanol alkyl amines and/or the ethanol alkyl amides have the function of reducing surface frictional resistance, since the long-chain alkyl group of the ethanol alkyl amines and/or the ethanol alkyl amides appears on the surface of the toner. As a result, the toner is unlikely to be adhered onto the carrier surface.

Test Example 5

A positively chargeable developer is prepared by blending 3 parts by weight of each of the toners obtained in Examples 5-1, 5-2, 5-3, 5-4, Comparative Examples 3 or 4 with 100 parts by weight of coat carrier 1, and a negatively chargeable developer is prepared by blending 3 parts by weight of Toner 5-5 obtained in Example 5-5 with 100 parts by weight of coat carrier 2.

Each of the developers obtained above is loaded on a modified apparatus of a commercially available copy machine ("FX 1075," manufactured by Fuji Xerox Co., Ltd.) equipped with an organic photoconductive (OPC) belt, and the long-time durability test is conducted under the same conditions as in Test Example 1. The tribo electric charge of developers, the carrier resistance, the formed images and the toner scum on the surface of the carrier observed by FE/SEM (manufactured by JEOL, Ltd. (Nihon Denshi Kabushiki Kaisha)) are evaluated in the same manner as in Test Example 1.

The results are shown in Table 5.

With regard to the fixing ability, it is found that in all of toners mentioned above, fixing can be achieved at a fixing temperature of not more than 180° C., which is a desired lowest fixing temperature, and that no offset image is generated even at 240° C. Therefore, the results of evaluation are not incorporated in the table.

TABLE 5

| | Tribo Electric Charge | | Carrier Resistance | | Image Density | | Background | | Presence of Toner Scum |
|---|---|---|---|---|---|---|---|---|---|
| | At Start | After Copying 1,000,000 Sheets | At Start | After Copying 1,000,000 Sheets | At Start | After Copying 1,000,000 Sheets | At Start | After Copying 1,000,000 Sheets | (After Copying 1,000,000 Sheets) |
| Example 5-1 | +20.3 | +19.4 | 8.59 | 8.66 | 1.40 | 1.42 | 0.21 | 0.27 | None |
| Example 5-2 | +20.0 | +18.9 | 8.56 | 8.71 | 1.40 | 1.44 | 0.20 | 0.30 | None |
| Example 5-3 | +21.3 | +20.4 | 8.63 | 8.70 | 1.38 | 1.41 | 0.17 | 0.26 | None |
| Example 5-4 | +21.0 | +20.2 | 8.61 | 8.75 | 1.41 | 1.42 | 0.24 | 0.28 | None |
| Example 5-5 | −21.1 | −20.7 | 8.60 | 8.73 | 1.39 | 1.43 | 0.22 | 0.29 | None |
| Comparative Example 3 | +22.7 | +12.0 | 8.67 | Not Determined | 1.37 | 0.41 | 0.34 | 1.62 | Present in All Carriers |
| Comparative Example 4 | +18.8 | +4.1 | 8.18 | 7.0 | 1.42 | 1.52 | 0.39 | 3.92 | Present Partially in Carriers |

As is clear from Table 5, in the case of using the toner obtained in Comparative Example 3 where no stearic acid or salts thereof is added, the tribo electric charge is halved, and the carrier resistance is undesirably increased to a level at which no measurements can be taken, so that the developer shows drastically poor performance. This can be verified by the facts that the image density is reduced to about a third of that at start, that the background is increased, and that the toner scum is generated.

Also, in the case of using the toner obtained in Comparative Example 4 where zinc stearate is externally added as a toner scum preventive, the tribo electric charge is drastically reduced, and the background is drastically increased although the image density is not significantly reduced. The reasons for such undesirable properties may be presumably the same as described in Test Example 1.

On the other hand, in cases of using toners obtained in Examples 5-1 to 5-5, it is found that the developers show long service life with good performance after copying 1,000,000 sheets while satisfying the desired low-temperature fixing ability, and that the formation of toner scum on carriers can be well prevented.

Test Example 6

A positively chargeable developer is prepared by blending 3 parts by weight of each of the toners obtained in Examples 6-1, 6-2 or 6-3 with 100 parts by weight of coat carrier 1.

Each of the developers obtained above is loaded on a modified apparatus of a commercially available copy machine ("FX 1075," manufactured by Fuji Xerox Co., Ltd.) equipped with an organic photoconductive (OPC) belt, and the long-time durability test is conducted under the same conditions as in Test Example 1. The tribo electric charge of developers, the carrier resistance, the formed images and the toner scum on the surface of the carrier observed by FE/SEM (manufactured by JEOL, Ltd. (Nihon Denshi Kabushiki Kaisha)) are evaluated in the same manner as in Test Example 1.

The results are shown in Table 6.

With regard to the fixing ability, it is found that in all of toners mentioned above, fixing can be achieved at a fixing temperature of not more than 180° C., which is a desired lowest fixing temperature, and that no offset image is generated even at 240° C. Therefore, the results of evaluation are not incorporated in the table.

The test results obtained in Test Example 5 for comparative toners 3 and 4 are also incorporated in the table.

no toner scum preventives are added, the tribo electric charge is halved, and the carrier resistance is undesirably increased to a level at which no measurements can be taken, so that the developer shows drastically poor performance. This can be verified by the facts that the image density is reduced to about a half of that at start, that the background is increased, and that the toner scum is generated.

Also, in the case of using the toner obtained in Comparative Example 4 where zinc stearate is externally added as a toner scum preventive, the tribo electric charge is drastically reduced, and the background is drastically increased although the image density is not significantly reduced.

On the other hand, in cases of using toners obtained in Examples 6-1 to 6-3, it is found that the developers show long service life with good performance after copying 1,000,000 sheets while satisfying the desired low-temperature fixing ability, and that the formation of toner scum on carriers can be well prevented.

Test Example 7

A positively chargeable developer is prepared by blending 3 parts by weight of each of the toners obtained in Example 1-1, Comparative Example 1 or 2 with 100 parts by weight of ferrite carrier "F-100," (manufactured by Powder Tech. Co., spherical carrier).

Each of the developers obtained above is loaded on a modified apparatus of a commercially available copy machine ("SD 2075," manufactured by Sharp Corporation), and the long-time durability test is conducted by a reverse development. The tribo electric charge of developers, the carrier resistance, the formed images and the toner scum on the surface of the carrier observed by FE/SEM (manufactured by JEOL, Ltd. (Nihon Denshi Kabushiki Kaisha)) are evaluated in the same manner as in Test Example 1. The results are shown in Table 7.

TABLE 6

| | Tribo Electric Charge | | Carrier Resistance | | Image Density | | Background | | Presence of Toner Scum |
|---|---|---|---|---|---|---|---|---|---|
| | At Start | After Copying 1,000,000 Sheets | At Start | After Copying 1,000,000 Sheets | At Start | After Copying 1,000,000 Sheets | At Start | After Copying 1,000,000 Sheets | (After Copying 1,000,000 Sheets) |
| Example 6-1 | +19.9 | +19.1 | 8.57 | 8.68 | 1.42 | 1.43 | 0.26 | 0.32 | None |
| Example 6-2 | +18.9 | +18.4 | 8.49 | 8.57 | 1.44 | 1.46 | 0.36 | 0.38 | None |
| Example 6-3 | +21.0 | +19.8 | 8.62 | 8.73 | 1.41 | 1.44 | 0.25 | 0.31 | None |
| Comparative Example 3 | +22.7 | +12.0 | 8.67 | Not Determined | 1.37 | 0.41 | 0.34 | 1.62 | Present in All Carriers |
| Comparative Example 4 | +18.8 | +4.1 | 8.18 | 7.0 | 1.42 | 1.52 | 0.39 | 3.92 | Present Partially in Carriers |

As is clear from Table 6, as mentioned above, in the case of using the toner obtained in Comparative Example 3 where

TABLE 7

| | Tribo Electric Charge | Carrier Resistance | Image Density | Background | Presence of Toner Scum |
|---|---|---|---|---|---|
| | After Copying | After Copying | After Copying | After Copying | (After Copying |

| | At Start | 1,000,000 Sheets | At Start | 1,000,000 Sheets | At Start | 1,000,000 Sheets | At Start | 1,000,000 Sheets | 1,000,000 Sheets) |
|---|---|---|---|---|---|---|---|---|---|
| Example 1-1 | +18.7 | +18.2 | 9.65 | 9.91 | 1.42 | 1.36 | 0.10 | 0.21 | None |
| Comparative Example 1 | +18.4 | +10.1 | 9.71 | Not Determined | 1.40 | 1.61 | 0.41 | 2.31 | Present in All Carriers |
| Comparative Example 2 | +17.7 | +3.4 | 9.39 | 9.21 | 1.46 | 0.71 | 0.51 | 4.20 | Present Partially in Carriers |

As is clear from Table 7, in the case where spherical carriers are used in stead of irregular-shaped sponge-type carrier, the toner of the present invention as obtained in Example 1-1 achieves the similar effects to that in the above Examples 1-1 to 6-3 using a sponge-type carrier, which has a long service life by showing good performance and good prevention of the formation of toner scum.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for two-component development comprising at least a binder resin and a coloring agent, wherein said binder resin comprises as a main component a polyester resin or a resin produced by carrying out concurrently addition polymerization and condensation polymerization in one reaction vessel, the toner containing in an inner portion thereof at least one of toner scum preventatives selected from the group consisting of:

(a) an aliphatic acid, metal salts thereof, and mixtures thereof;

(b) a monoalkyl phosphate, a dialkyl phosphate, and mixtures thereof;

(c) carbonyloxy and amido groups-containing amine, salts thereof, and mixtures thereof; and (d) a compound having the following general formula (D-1):

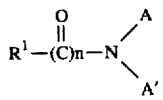

(D-1)

wherein $R^1$ represents an alkyl group, aralkyl group or alkenyl group, each having 7 to 24 carbon atoms; A and A', which may be identical or different, independently represent a hydrogen atom, methyl group or $—CH_2CH_2OR^2$, wherein $R^2$ represents a hydrogen atom, an alkyl group, aralkyl group or alkenyl group, each having 8 to 24 carbon atoms, or

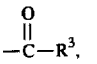

wherein $R^3$ represents an alkyl group, aralkyl group or alkenyl group, each having 8 to 24 carbon atoms; and n is equal to 0 to 1, and wherein said toner is prepared by a method comprising the step of mixing said toner scum preventatives with said binder resin.

2. The toner according to claim 1, wherein said toner scum preventive is selected from the group of (a) and (b), and wherein said toner scum preventive is added to the binder resin in an amount of 0.1 to 5.0 parts by weight, based on 100 parts by weight of the binder resin.

3. The toner according to claim 1, wherein said toner scum preventive is selected from the group of (c), and wherein said toner scum preventive is added to the binder resin in an amount of 0.5 to 5.0 parts by weight, based on 100 parts by weight of the binder resin.

4. The toner according to claim 1, wherein said carbonyloxy and amido groups-containing amine has the following general formula (C-1):

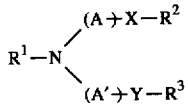

(C-1)

wherein $R^1$ represents an alkyl group, alkenyl group, aralkyl group or hydroxyalkyl group, each having up to 24 carbon atoms; $R^2$ and $R^3$, which may be identical or different, independently represent a hydrogen atom, or an alkyl group or alkenyl group, each having up to 24 carbon atoms; A and A', which may be identical or different, independently represent an alkylene group having 1 to 4 carbon atoms; X represents —NHCO— or —CONH—; and Y represents

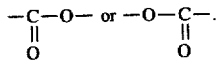

5. The toner according to claim 1, wherein said toner scum preventive is selected from the group of (d), and wherein said toner scum preventive is added to the binder resin in an amount of 0.5 to 7.0 parts by weight, based on 100 parts by weight of the binder resin.

6. The toner according to claim 1, wherein said polyester resin has a softening point of not less than 95° C. and not more than 160° C. as determined by koka-shiki type flow tester and a glass transition temperature of not less than 50° C. and not more than 80° C. as determined by differential scanning calorimeter.

7. The toner according to claim 1, wherein said binder resin comprises as a main component a resin produced by carrying out concurrently addition polymerization and condensation polymerization in one reaction vessel, and wherein said addition polymerization is a radical polymerization for obtaining a vinyl resin, and said condensation polymerization is carried out for obtaining a resin selected from the group consisting of polyester resins, polyester-polyamide resins and polyamide resins.

8. A developer composition comprising a carrier having a rugged surface and the toner according to claim 1.

9. The developer composition according to claim 8, wherein said carrier having a rugged surface is porous.

10. The developer composition according to claim 8, wherein said carrier having a rugged surface is irregular-shaped iron particles or a spherical carrier.

11. The developer composition according to claim 10, wherein said irregular-shaped iron particles have an average particle diameter of 50 to 200 μm, and wherein said irregular-shaped iron particles have a projecting portion and a concave portion, an average height between the projecting portion and the concave portion being not less than 10 μm.

* * * * *

UNITED STATES PATENT AND TRADEMARK OFFICE
Certificate

Patent No. 5,472,819

Patented: December 5, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Nirohiro Hayashi, Wakayama, Japan; Kanji Yoshimura, Chiba, Japan; and Kuniyasu Kawabe, Wakayama, Japan.

Signed and Sealed this Twenty-eighth Day of June 2005.

MARK F. HUFF
*Supervisory Patent Examiner*
Art Unit 1756

UNITED STATES PATENT AND TRADEMARK OFFICE
Certificate

Patent No. 5,472,819 Patented: December 5, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Norihiro Hayashi, Wakayama, Japan; Kanji Yoshimura, Chiba, Japan; and Kuniyasu Kawabe, Wakayama, Japan.

Signed and Sealed this Sixth Day of September 2005.

MARK F. HUFF
*Supervisory Patent Examiner*
Art Unit 1756